United States Patent [19]

White et al.

[11] 3,966,352

[45] June 29, 1976

[54] VARIABLE AREA TURBINE

[75] Inventors: Loren Hawdon White, East Hartford; John Herman Young, South Windsor, both of Conn.

[73] Assignee: United Technologies Corporation, Hartford, Conn.

[22] Filed: June 30, 1975

[21] Appl. No.: 591,554

[52] U.S. Cl. ..... 415/115; 415/160; 415/116; 415/151

[51] Int. Cl.[2] ..... F01D 5/08

[58] Field of Search ..... 415/115, 116, 117, 178, 415/147, 149, 160, 151; 60/39.31, 39.66

[56] References Cited

UNITED STATES PATENTS

| | | | |
|---|---|---|---|
| 2,266,577 | 12/1941 | Warren | 415/170 R |
| 3,542,484 | 11/1970 | Mason | 415/160 |
| 3,582,231 | 6/1971 | Zerlauth | 415/160 |
| 3,652,177 | 3/1972 | Loebel | 415/116 |
| 3,663,118 | 5/1972 | Johnson | 415/147 |
| 3,674,377 | 7/1972 | Trappmann | 415/147 |
| 3,695,777 | 10/1972 | Westphal et al. | 415/147 |

FOREIGN PATENTS OR APPLICATIONS

| | | | |
|---|---|---|---|
| 1,119,774 | 7/1968 | United Kingdom | 415/116 |

*Primary Examiner*—Henry F. Raduazo
*Attorney, Agent, or Firm*—Robert C. Walker

[57] ABSTRACT

Apparatus for varying the nozzle area in the turbine section of a gas turbine engine is disclosed. Nozzle guide vanes extend across the flow path for the working medium gases and are rotatable to alter the area of the nozzle. In one embodiment the rotatable vanes are cantilevered from the outer engine case and are opposed at their radially inner ends by a shroud which is affixed to the inner engine case. The outer engine case has a double wall type construction including a plurality of bearing cartridges disposed between the walls.

10 Claims, 3 Drawing Figures

VARIABLE AREA TURBINE

BACKGROUND OF THE INVENTION

The invention herein described was made in the course of or under a contract with the Department of the Navy.

1. Field of the Invention

This invention relates to gas turbine engines and more particularly to engines having nozzle guide vanes which are both rotatable and coolable.

2. Description of the Prior Art

In a gas turbine engine of the type referred to above, pressurized air and fuel are burned in a combustion chamber to add thermal energy to the medium gases flowing therethrough. The effluent from the chamber comprises high temperature gases which are flowed downstream in an annular flow path through the turbine section of the engine. Nozzle guide vanes at the inlet to the turbine direct the medium gases onto a multiplicity of blades which extend radially outward from the engine rotor. The nozzle guide vanes are particularly susceptible to thermal damage and are commonly cooled to control the temperature of the material comprising the vanes. Cooling air from the engine compressor is bled through suitable conduit means to an annular chamber which is located radially outward of the working medium flow path and thence to the vanes. The nozzle guide vanes in conventional constructions have platforms which separate the cooling air in the chamber from the working medium gases in the flow path.

Recent efforts to improve the performance of gas turbine engines have led to the development of turbines having variable geometry nozzles. In a typical construction such as that shown in U.S. Pat. No. 3,224,194 to DeFeo et al entitled "Gas Turbine Engine", the area of the turbine nozzle is varied with the engine power level to optimize the flow characteristics of the working medium gases in the region. In DeFeo a plurality of rotatable vanes are positioned circumferentially about the medium flow path to form the turbine nozzle. The ends of each vane are affixed to their respective supporting structure by ball and socket type connectors. The connectors accommodate minor variations in the angle of the vane radial axis which are caused by differential axial expansion between the supporting structures.

Some newly developed engines have incorporated rotatable vanes which are cantilevered from the outer case structure to eliminate the deleterious effects on the vanes of thermal expansion between the cases. Typically, as is shown in U.S. Pat. No. 3,542,484 to Mason entitled "Variable Vanes" and in U.S. Pat. No. 3,652,177 to Loebel entitled "Installation for the Support of Pivotal Guide Blades", the vanes are mounted from the outer case and extend radially inward toward but independently of the inner case. In both constructions the axial gas pressure load on each vane is transmitted to the outer case through a cylindrical bushing which surrounds the stem of the vane. The radial gas pressure load on each vane is transmitted in Mason through a bearing ring to the outer case and in Loebel through the cylindrical bushing to the outer case. An inherent problem with cantilevered vane constructions is the control of medium gas leakage between the tip of each vane and the surrounding shroud at the inner case. The shroud is supported by the inner engine case and is displaced radially according to the thermal response characteristics of the inner case. On the other hand, the vanes are supported by the outer case and are displaced radially according to the thermal response characteristics of the outer case. In most constructions a substantial initial clearance is provided to prevent binding between the vanes and the inner shroud under transient conditions with the result that leakage is excessive during nearly all periods of operation. The leakage problem is particularly acute in high temperature engines where the relative radial displacement due to thermal expansion is excessive between the inner shroud and the vane tips.

In high temperature engines cooling air from the compressor is commonly flowable between the outer engine case and an outer shroud surrounding the flow path. Each rotatable vane has a cylindrical platform which is integral with the outer shroud. The airfoil section of each vane extends beyond its respective platform and overhangs a portion of the outer shroud. Sufficient, clearance between the overhung portion of each vane and the shroud must be provided to insure rotatability of the vane without binding against the shroud. An excessive clearance, however, deleteriously effects the aerodynamic performance of the turbine by allowing the medium gases to leak past the overhung region without being fully redirected by the airfoil.

Continuing efforts are underway to provide turbine apparatus which in combination with rotatable vanes allows variations in nozzle area with minimized leakage of the working medium gases.

SUMMARY OF THE INVENTION

A primary object of the present invention is to provide a variable area nozzle across the flow path of the working medium gases in the turbine section of a gas turbine engine. A further object is to provide a nozzle having a plurality of vanes which are freely rotatable under all engine conditions to vary the nozzle area. Another object is to provide cooling air to the rotatable vanes. Additional objects are to provide a lightweight outer engine case which is thermally compatible with the inner engine case and in conjunction therewith controls the clearances between the rotatable vanes and their inner and outer shrouds to prevent the leakage of working medium gases past the vanes.

In accordance with the present invention a plurality of cylindrical bearing cartridges each supporting a rotatable turbine vane are mounted in an outer engine case having a double wall type construction including an inner wall which is positioned by the bearing cartridges.

A primary feature of the present invention is the bearing cartridges which have a carbon bushing at each end for support under axial and radial gas pressure loads of the rotatable vane mounted therein. Shroud segments forming a portion of the inner wall of the outer engine case are held in radial position with respect to the rotatable vanes by the bearing cartridges. A pair of annular rings at the inner wall of the outer case join the shroud segments to the bearing cartridges. The inner wall of the outer case responds more rapidly to thermal changes in the medium flow path than does the outer wall but the combined response of the inner and outer walls closely approximating the response of the inner engine case.

A principal advantage of the present invention is the freedom of the vanes to rotate within the bearing cartridge without binding due to gas pressure loads and without binding against the inner or outer shroud segments. Another advantage of the present invention is the ability to match the combined thermal response of the outer engine case having inner and outer walls to the thermal response of the inner engine case in controlling the radial clearance between the vane tips and the inner shroud. The outer case construction has separated inner and outer walls which permit the flow of cooling air to the vanes without a substantial pressure drop through the case region.

DETAILED DESCRIPTION OF THE PREFERRED EMBODIMENT

Figure 1:
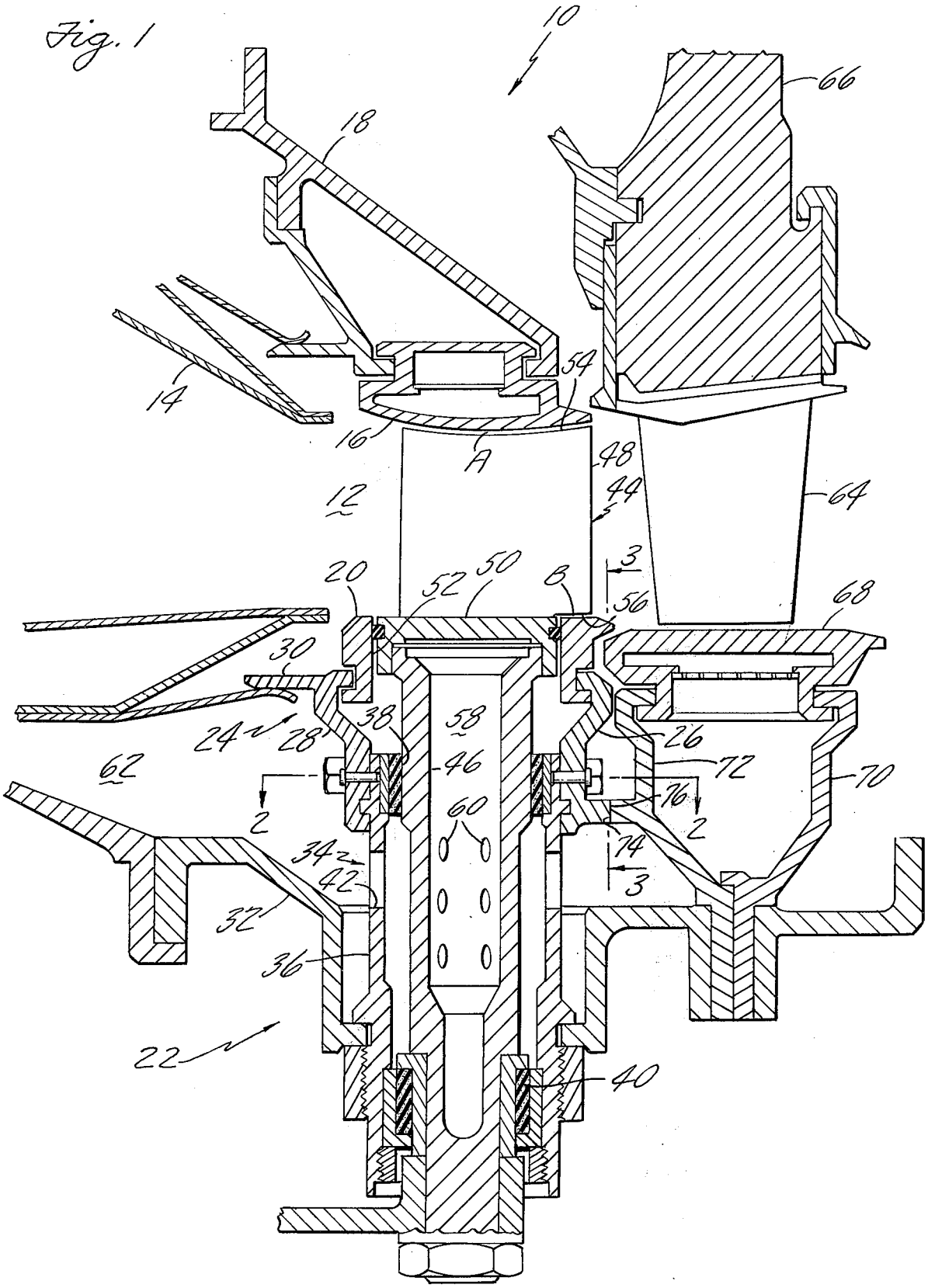
FIG. 1 is a cross section view taken through a portion of the turbine section of a gas turbine engine.

A portion of the turbine section 10 of a gas turbine engine is shown in FIG. 1. A flow path 12 extends axially downstream through the turbine section of the engine from a combustion chamber 14. A portion of the flow path 12 is inwardly bounded by an inner shroud 16 which is directly supported by an inner engine case 18. The inner shroud 16 is opposed across the flow path 12 by an outer shroud 20 which is affixed to an outer case 22. The outer case 22 is of the double wall construction type and has an inner wall 24 including the outer shroud 20, a downstream support ring 26 and an upstream support ring 28 having a cylindrical guide flange 30. The cylindrical guide flange 30 engages the downstream end of the combustion chamber 14. The rings of the inner wall 24 are joined to an outer wall 32 by a cylindrical bearing cartridge 34 to form the double wall outer case 22.

The bearing cartridge has a housing 36 which is adapted to positionally align an inner carbon bushing 38 and an outer carbon bushing 40. The housing 36 has incorporated therein a plurality of cartridge apertures 42 through which cooling air is flowable during operation of the engine. A rotatable guide vane 44 has a stem section 46 which is mounted for rotational movement within the bearing cartridge 34. The vane further has an airfoil section 48 extending across the flow path 12 and a platform section 50 which is interposed in a cylindrical aperture 52 in the outer shroud 20. The airfoil section 48 of the vane 44 has a tip portion 54 and downstream portion 56 which overhangs the shroud 20. The vane stem 46 has a hollow cavity 58 included therein and a plurality of orifices 60 which communicatively join the cavity to an annular chamber 62 between the inner and outer walls of the outer engine case 22.

A turbine blade 64 which extends radially outward from a rotor 66 is disposed across the flow path 12 at a location axially downstream of the vane 44. A blade tip shroud 68 radially surrounds the blade 64. The tip shroud is supported by a downstream member 70 and an upstream member 72. The upstream member 72 has an upstream face 74 which is in opposing contact with a downstream face 76 of the downstream support ring 26.

Figure 2:
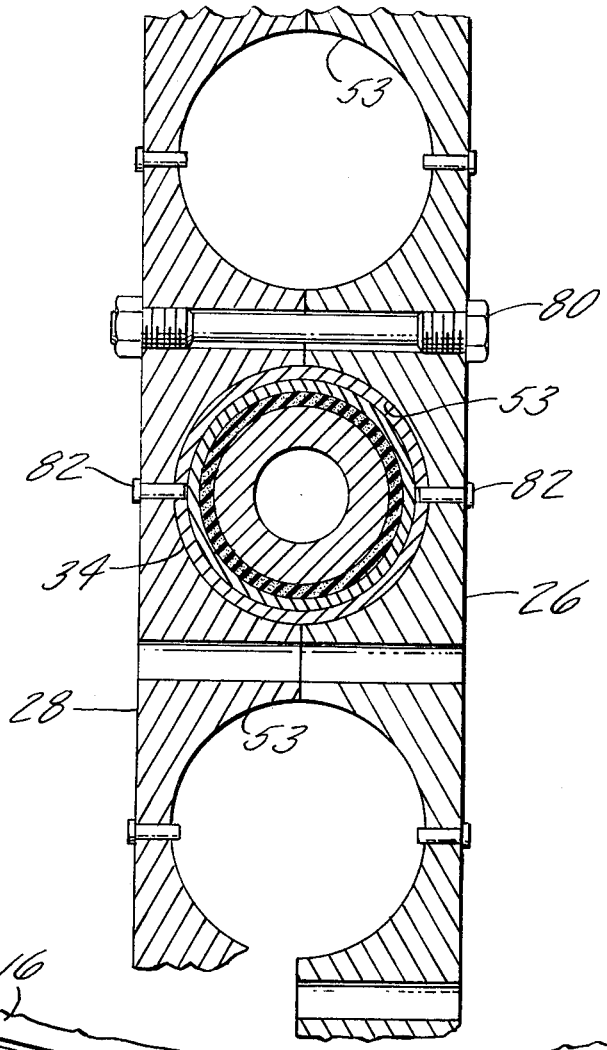
FIG. 2 is a sectional view taken along the line 2-2 as shown in FIG. 1.
Figure 3:
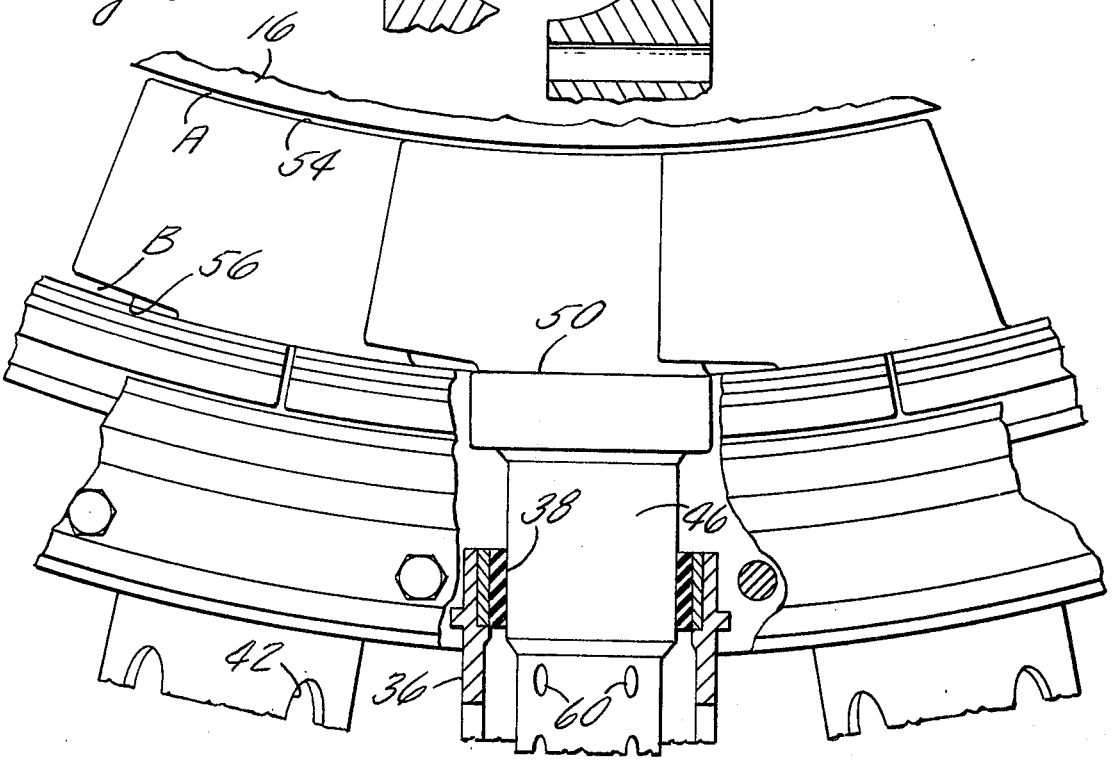
FIG. 3 is a sectional view taken along the line 3-3 as shown in FIG. 1.

As is shown in FIG. 2 the upstream support ring 28 is joined to the downstream support ring 26 by bolting means 80. The two rings in combination form the circular opening 53. Locating pins 82 orient the bearing cartridges 34 to a preferred position within the opening 53 wherein the stem orifices 60 and the housing apertures 42 are positionally aligned at an optimum vane angle for minimum aerodynamic resistance between the annular chamber 62 and the vane cavity 58.

During operation of the engine the guide vane 44 is rotatable to an angle of optimum performance. A positive clearance A is maintained between the tip 54 of each vane 44 and the enclosing inner shroud 16. As engine temperatures increase the tip 54 becomes displaced radially outward with its supporting structure, the outer engine case. Correspondingly the inner shroud 16 is displaced radially outward with its supporting structure, the inner engine case. The more closely the thermal responses of the inner and outer cases are matched, the smaller the initial clearance A is required to insure rotatability of the vanes 44 without binding. In the preferred embodiment shown in FIG. 1, the combined response of the inner and outer walls of the outer engine case 22 approximates the response of the inner engine case 18 and the clearance A is, accordingly, minimized.

The inner wall 24 of the outer case 22 is spaced radially inward of the outer wall 32 forming the annular chamber 62 therebetween. The bearing cartridges 34 extend radially across the chamber 62 to place the cartridge apertures 42 in unobstructed relation to the flow of cooling air through the chamber 62.

The downstream face 76 of the downstream support ring 26 abuts the upstream face 74 of the member 72 to prevent axial deflection of the cartridges 34 in response to gas pressure loads on the vanes 44. The upstream support ring 28 and the downstream support ring 26 conjunctively form the circular opening 53 which are at equidistant locations about the engine circumference. Correspondingly, the opening 53 holds the vanes 44 which extend from the cartridges 34 at equidistant positions about the flow path 12.

The bearing housing 36, which contains the inner carbon bushing 38 and the outer carbon bushing 40, structurally connects the inner wall 22 of the outer case to the outer wall 32. The bearing housing performs the additional function of holding the carbon bushings in alignment for support of the vane stem 46 to prevent cracking or chipping of the carbon bushings.

The vane 44, including the downstream portion 56 thereof, which overhangs the outer shroud 20, is radially positioned with respect to the bearing housing 36 by the outer carbon bushing 40. Similarly, the outer shroud 20 is radially positioned with respect to the bearing housing 36 by the downstream support ring 26 and the upstream support ring 28. In the described construction the clearance B between the downstream portion 56 of the vane and the outer shroud 20 is set to a minimum value which prevents excess leakage of medium gases therethrough while insuring rotatability of the vane 44 without binding against the shroud 20.

Although the invention has been shown and described with respect to a preferred embodiment thereof, it should be understood by those skilled in the art that various changes and omissions in the form and detail thereof may be made therein without departing from the spirit and the scope of the invention.

Having thus described a typical embodiment of our invention, that which we claim as new and desire to secure by Letters Patent of the United States is:

1. In a gas turbine engine of the type having an inner shroud and an outer shroud which radially bound a flow path for the working medium gases in the engine, a variable area nozzle including a cantilevered guide vane which is rotatable and has an airfoil section overhanging a portion of the outer shroud, wherein the improvement comprises:

means for controlling the radial clearance between the overhung vane and the opposing outer shroud including a bearing cartridge having a cylindrical bushing which axially and radially positions the rotatable vane, an annular ring which extends circumferentially about the engine and which is attached to the bearing cartridge, and means for attaching the outer shroud to the annular ring to axially and radially position the outer shroud thereby fixing the radial position of said shroud with respect to said rotatable vane.

2. The invention according to claim 1 wherein the outer shroud is segmented.

3. The invention according to claim 1 wherein the guide vane has a plurality of orifices leading to a hollow cavity therein and the bearing cartridge has one or more apertures through which cooling air is flowable to the cavity and further including a locating pin which extends through the annular ring to engage the cartridge at a preferred orientation wherein the vane orifices and the cartridge apertures are in substantial alignment to minimize aerodynamic losses in the cooling air flowing to the cavity.

4. The invention according to claim 1 wherein the rotatable vane is cantilevered radially inward from the bearing cartridge.

5. The invention according to claim 4 wherein the cartridge includes a cylindrical bushing.

6. The invention according to claim 5 wherein the bushing cartridge is fabricated from a carbonaceous material.

7. The invention according to claim 1 wherein the annular ring includes an upstream segment and a downstream segment and wherein the downstream segment is adapted to support each bearing cartridge under axial pressure loads exerted by the working medium gases on the rotatable vane mounted therein.

8. The invention according to claim 7 further including a combustion chamber located upstream of the rotatable vanes and wherein the upstream segment of the annular ring is adapted to radially support the downstream end of the combustion chamber.

9. In the turbine section of a gas turbine engine of the type having a variable area nozzle including a plurality of rotatable guide vanes which are cantilevered across the flow path for the working medium gases from a bearing cartridge, the improvement which comprises:

an inner engine case spaced radially inward of the flow path for the working medium gases;

an inner shroud which is attached to the inner engine case and radially opposes the tips of the cantilevered guide vanes;

a double wall outer engine case which is spaced radially outward of the flow path for the working medium gases and includes an outer wall from which the bearing cartridges extend and an inner wall having an annular ring affixed to a radially inward portion of the cartridges, the thermal response of the double wall case being closely matched to the thermal response of the inner case to control the radial clearance between the cantilevered vanes and the opposing inner shroud.

10. The invention according to claim 9 which further includes an outer shroud held in radial position relative to the cartridge by the annular ring and wherein the vanes each have a downstream portion which overhangs the outer shroud and is held in relative radial position thereto by the respective bearing cartridge to control the clearance between the overhung portion of the vane and the outer shroud.

* * * * *